US010619920B2

(12) United States Patent
Schurr

(10) Patent No.: US 10,619,920 B2
(45) Date of Patent: Apr. 14, 2020

(54) TWO PIECE BASE ASSEMBLY OF A DRYER

(71) Applicant: WHIRLPOOL CORPORATION, Benton Harbor, MI (US)

(72) Inventor: Daniel A. Schurr, Wyoming, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 100 days.

(21) Appl. No.: 15/722,363

(22) Filed: Oct. 2, 2017

(65) Prior Publication Data

US 2019/0101330 A1 Apr. 4, 2019

(51) Int. Cl.

| | |
|---|---|
| ***D06F 58/00*** | (2020.01) |
| ***F26B 11/02*** | (2006.01) |
| ***F25D 23/00*** | (2006.01) |
| ***D06F 58/20*** | (2006.01) |
| *D06F 39/12* | (2006.01) |

(52) U.S. Cl.

CPC ..... *F26B 11/022* (2013.01); *D06F 58/20* (2013.01); *F25D 23/00* (2013.01); *D06F 39/12* (2013.01); *D06F 39/125* (2013.01)

(58) Field of Classification Search

CPC ..... F26B 11/022; D06F 58/06; D06F 58/20; F25D 23/00

USPC ..... 34/108, 109, 499, 602, 121

See application file for complete search history.

(56) References Cited

U.S. PATENT DOCUMENTS

| | | | | |
|---|---|---|---|---|
| 3,218,732 | A | 11/1965 | Alaback | |
| 5,056,341 | A | 10/1991 | Mori et al. | |
| 5,265,347 | A | 11/1993 | Woodson et al. | |
| 5,515,702 | A | 5/1996 | Park | |
| 8,051,580 | B2 * | 11/2011 | Bruneau | D06F 58/08 248/638 |
| 8,631,586 | B2 | 1/2014 | Leroy | |
| 9,453,296 | B2 | 9/2016 | Rockwell et al. | |
| 2005/0138836 | A1 * | 6/2005 | Hwang | D06F 39/12 34/603 |
| 2007/0175907 | A1 | 8/2007 | Kempe et al. | |

FOREIGN PATENT DOCUMENTS

| | | | |
|---|---|---|---|
| EP | 0561201 | A1 | 9/1993 |
| WO | 2016066201 | A1 | 5/2016 |

* cited by examiner

*Primary Examiner* — John P McCormack
(74) *Attorney, Agent, or Firm* — Price Heneveld LLP

(57) ABSTRACT

A dryer is provided herein and includes a cabinet and a dryer drum disposed in a cavity of the cabinet. A base assembly of the dryer includes a top piece and a bottom piece. The top piece has a plurality of debosses formed therefrom and each deboss has an end portion. The bottom piece is coupled to the top piece to define a cavity and has embosses formed therefrom. Each emboss is vertically aligned with a corresponding deboss and each emboss has an end portion in abutting contact with the end portion of the corresponding deboss. A plurality of mechanical fasteners are configured to engage the end portions of the embosses to the end portions of the debosses.

19 Claims, 4 Drawing Sheets

TWO PIECE BASE ASSEMBLY OF A DRYER

BACKGROUND

The present disclosure generally relates to a base assembly of a dryer, and more particularly, to a two piece base assembly benefiting from a modular design and easily installed to the dryer.

SUMMARY

According to one aspect of the present disclosure, a dryer is provided and includes a cabinet and a dryer drum disposed in a cavity of the cabinet. A base assembly of the dryer includes a top piece and a bottom piece. The top piece has a central portion, a perimeter portion enclosing the central portion, and a plurality of debosses formed from the central portion. The bottom piece has a central portion, a perimeter portion enclosing the central portion, and a plurality of embosses formed from the central portion. The perimeter portion of the top piece is coupled to the perimeter portion of the bottom piece and the debosses are coupled to the embosses at a common plane passing through the base assembly.

According to another aspect of the present disclosure, a dryer is provided and includes a cabinet and a dryer drum disposed in a cavity of the cabinet. A base assembly of the dryer includes a top piece and a bottom piece. The top piece has a plurality of debosses formed therefrom and each deboss has an end portion. The bottom piece is coupled to the top piece to define a cavity and has embosses formed therefrom. Each emboss is vertically aligned with a corresponding deboss and each emboss has an end portion in abutting contact with the end portion of the corresponding deboss. A plurality of mechanical fasteners are configured to engage the end portions of the embosses to the end portions of the debosses.

According to yet another aspect of the present disclosure, a dryer is provided and includes a cabinet and a dryer drum disposed in a cavity of the cabinet. A base assembly of the dryer includes a top piece and a bottom piece. The top piece has a plurality of debosses and the bottom piece is coupled to the top piece to define a cavity and has a plurality of embosses coupled to the debosses. An intermediate member is confined in the cavity and is configured to surround couplings between the debosses and embosses.

These and other aspects, objects, and features of the present disclosure will be understood and appreciated by those skilled in the art upon studying the following specification, claims, and appended drawings.

DETAILED DESCRIPTION OF EMBODIMENTS

As required, detailed embodiments of the present disclosure are disclosed herein. However, it is to be understood that the disclosed embodiments are merely exemplary and may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the teachings of the present disclosure.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Figure 1:
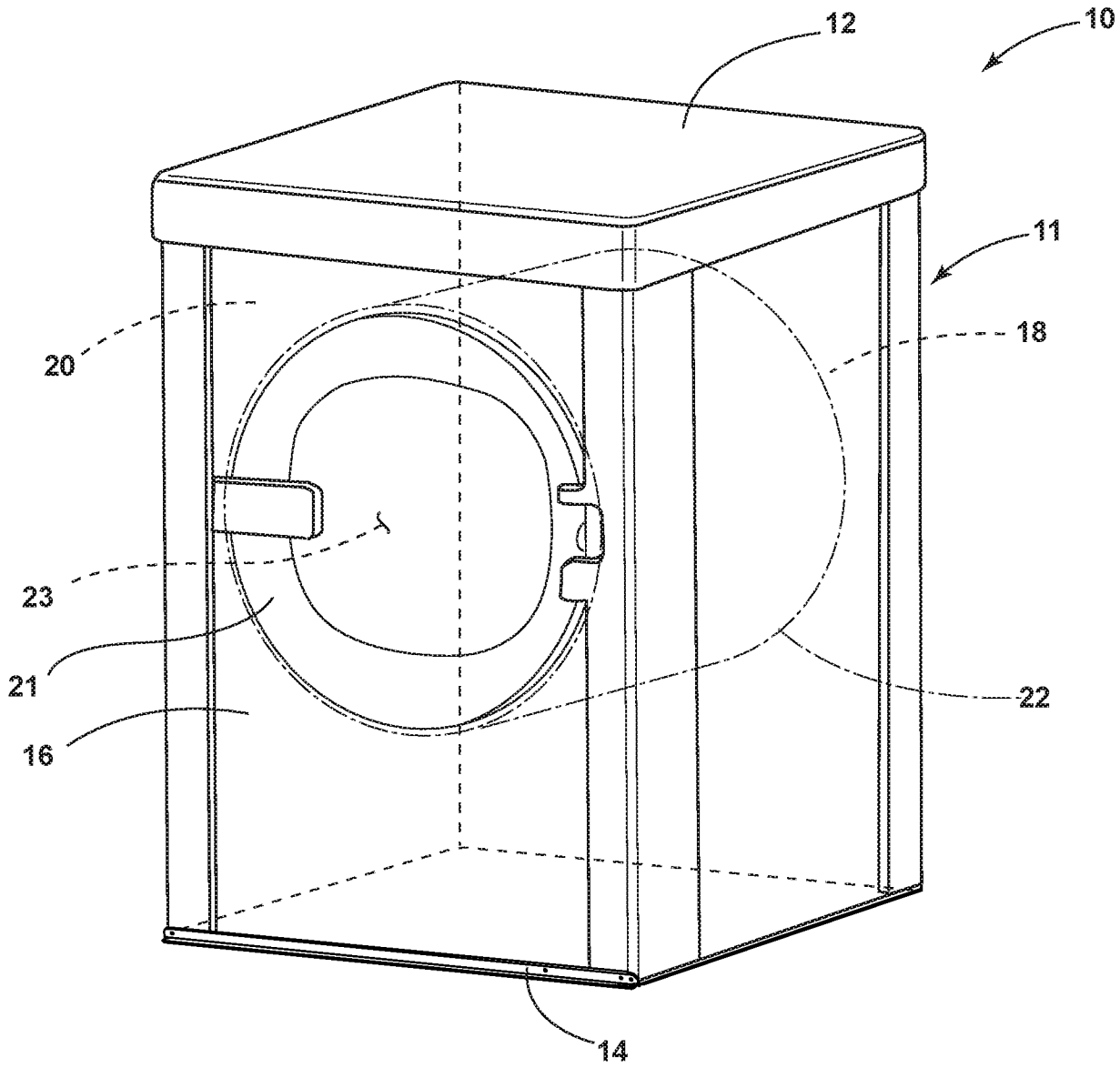
FIG. 1 is a perspective view of a household appliance exemplarily shown as a dryer.

Referring to FIG. 1, a household appliance is exemplarily shown as a dryer 10. The dryer 10 includes a cabinet 11 defined by a top panel 12 connected to a base assembly 14 by a front panel 16, a rear panel 18, and two side panels 20. The front panel 16 includes a hinged door 21 allowing access to a dryer drum 22 disposed in a dryer cavity 23 of the cabinet 11. The dryer drum 22 and other dryer components may be supported by the base assembly 14. Examples of other dryer components may include a motor, a blower, air ducts, heating elements, additional support structures, and other common components known to a skilled artisan. As will be described in greater detail herein, the base assembly 14 benefits from a modular two-piece design that is easily assembled and installed to the dryer 10 or other household appliance. The base assembly 14 also features a sound reduction means to lessen the noise levels produced by the dryer or other household appliance.

Figure 2:
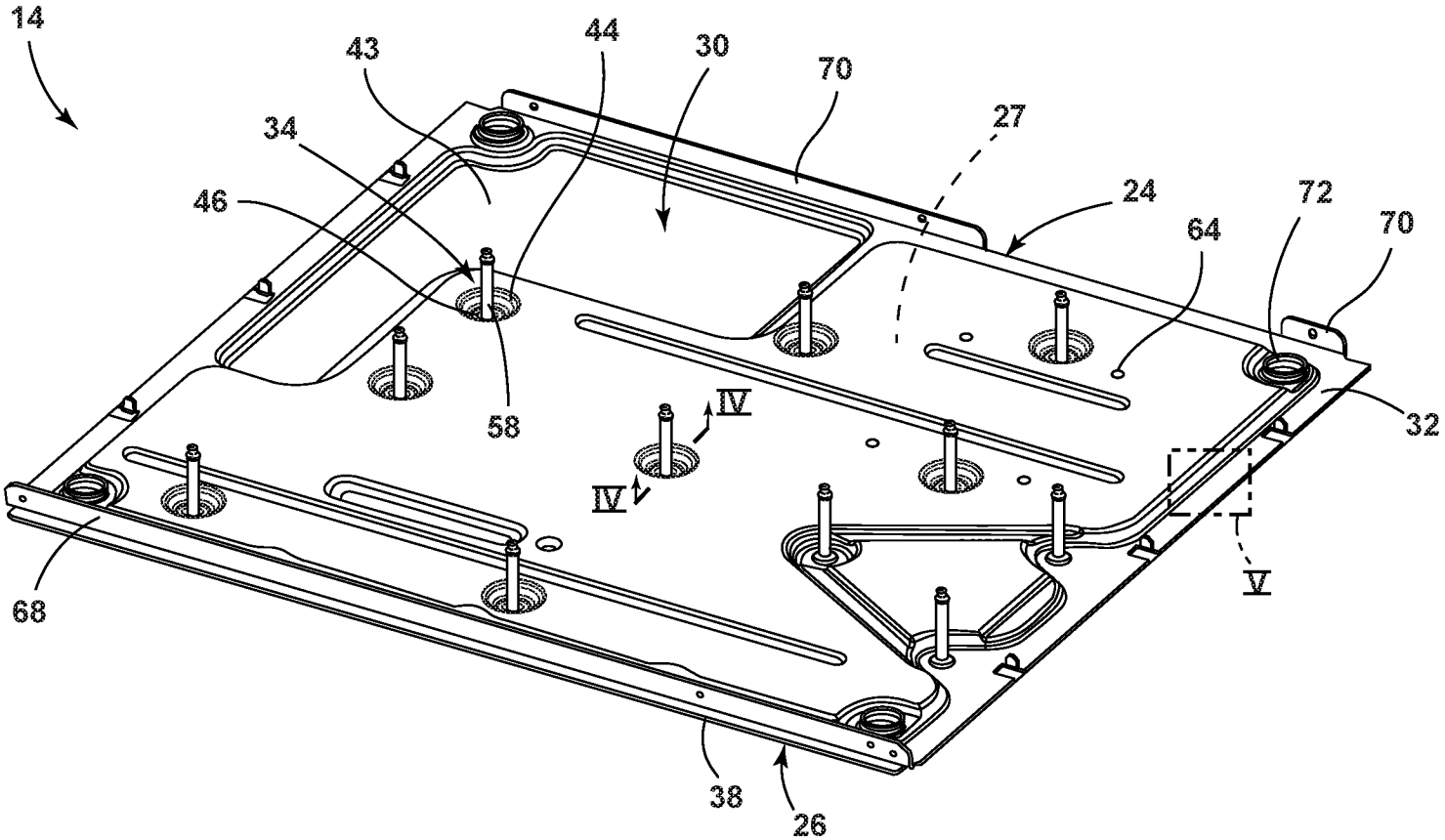
FIG. 2 is a perspective view of a base assembly of the dryer.
Figure 3:
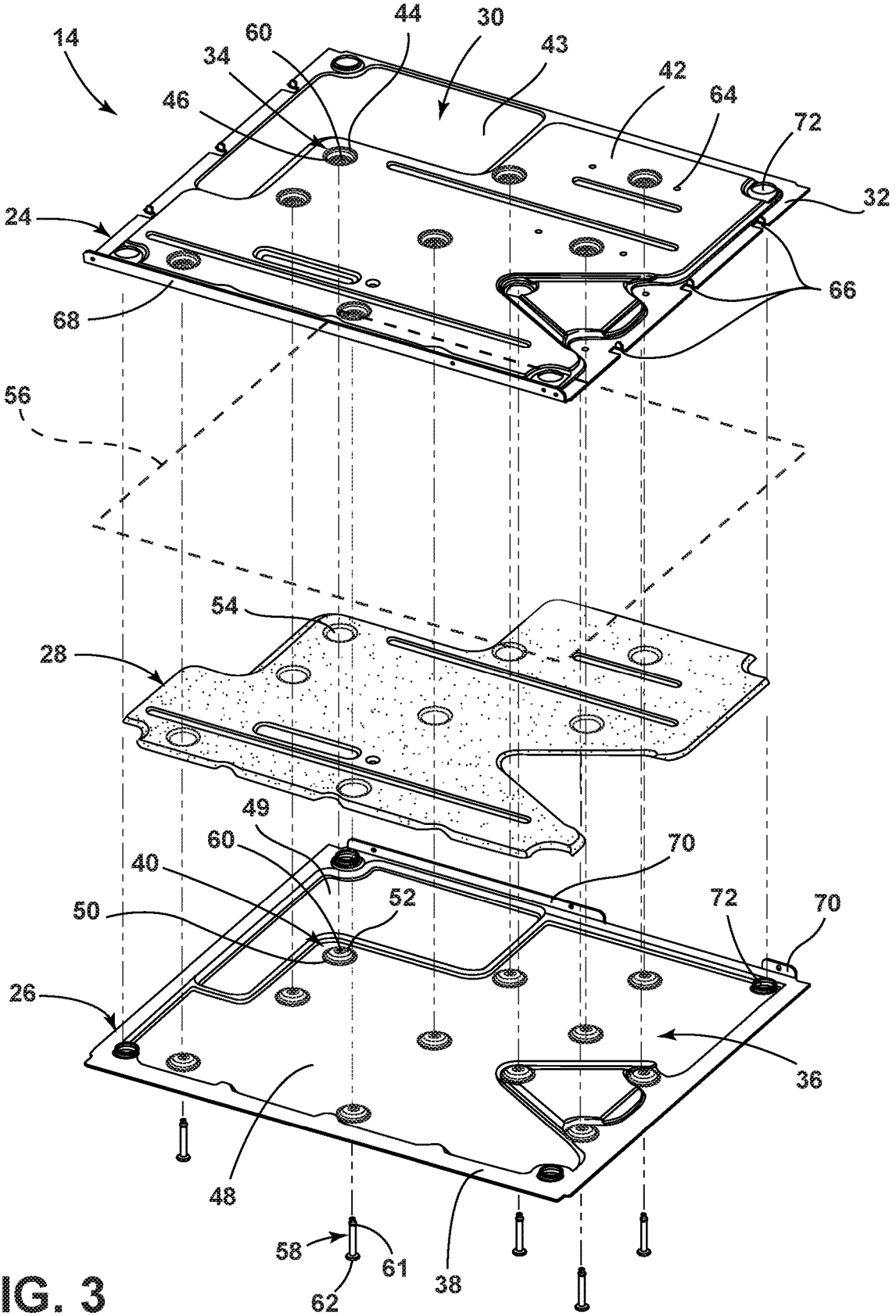
FIG. 3 is an exploded view of the base assembly shown in FIG. 2.

Referring to FIGS. 2 and 3, the base assembly 14 is shown in an exemplary rectangular shaped configuration and includes a top piece 24 coupled to a bottom piece 26 to define a cavity 27 in which to confine an intermediate member 28. The top and bottom pieces 24, 26 may each be unitary in construction and are generally constructed from a rigid or semi-rigid material such as, but not limited to, plastic or metal (e.g., steel). The top piece 24 includes a central portion 30, a perimeter portion 32, and a plurality of debosses 34 formed from the central portion 30. The bottom piece 26 includes a central portion 36, a perimeter portion 38, and a plurality of embosses 40 formed from the central portion 36.

In the depicted embodiment, the debosses 34 are formed from an upper platform 42 of the central portion 30 of the top piece 24, the upper platform 42 being elevated in relation to the perimeter portion 32 of the top piece 24. The central portion 30 may also form a lower platform 43 that is dropped in relation to the perimeter portion 32 of the top piece 24. The debosses 34 may be variously located on the upper platform 42 and each correspond to an indent having a frustoconical shape defined by a sidewall 44 and an end portion 46. The embosses 40 are formed from a lower platform 48 of the central portion 36 of the bottom piece 26, the lower platform 48 being dropped in relation to the perimeter portion 38 of the bottom piece 26. A portion 49 of the lower platform 48 may be in abutting contact with the lower platform 43 of the top piece 24 to provide additional clearance to dryer components located thereabove. The embosses 40 are located on the lower platform 48 to complement the location of the debosses 34. Each of the embosses 40 correspond to a raised relief having a frustoconical shape defined by a sidewall 50 and an end portion 52. While described herein as having frustoconical shapes, it will be understood that the debosses 34 and/or the embosses 40 may be configured as other shapes, if desired.

In assembly, the intermediate member 28 is positioned atop the lower platform 48 of the bottom piece 26 and includes a plurality of through holes 54 each configured to accommodate a corresponding emboss 40. Accordingly, the intermediate member 28, by way of through holes 54, provides a self-alignment feature to position the intermediate member 28 relative to the bottom piece 26. In one embodiment, the intermediate member 28 is constructed from a sound dampening material including, but not limited to, a foam or fiber based material. In such embodiments, the intermediate member 28 is configured to reduce noise levels produced by the dryer 10.

Figure 4:
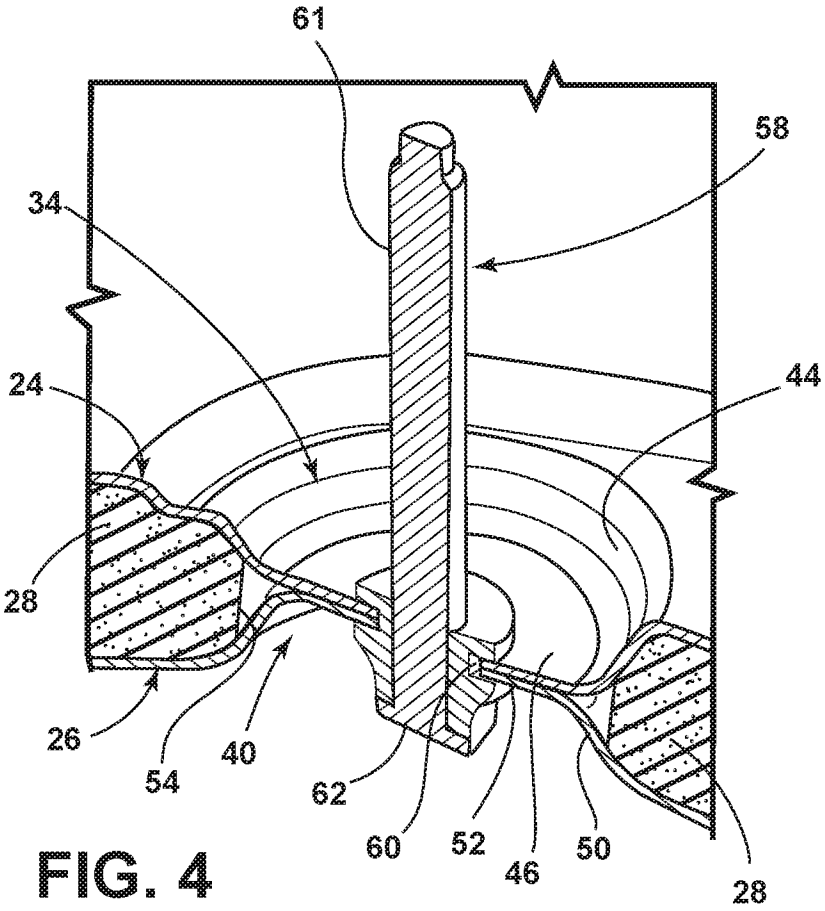
FIG. 4 is a cross-sectional view taken along line IV-IV in FIG. 2.

Next, the top piece 24 is positioned over the bottom piece 26 and the intermediate member 28 such that each emboss 40 of the bottom piece 26 is vertically aligned with a corresponding deboss 34 of the top piece 24. The top piece 24 may then be lowered such that each deboss 34 is received in a corresponding through hole 54 of the intermediate member 28. As a result, the end portion 46 of each deboss 34 comes into abutting contact with the end portion 52 of the corresponding emboss 40. Additionally, the perimeter portion 32 of the top piece 24 comes into abutting contact with the perimeter portion 38 of the bottom piece 26. Accordingly, the intermediate member 28 also serves to align the top piece 24 with the bottom piece 26 by virtue of each through hole 54 of the intermediate member 28 being configured to accommodate a corresponding deboss 34. Due to the positional relationship between a given emboss 40 and the corresponding deboss 34, portions of the base assembly 14 may have a substantially corrugated cross-section (FIG. 4).

With further reference to FIGS. 2 and 3, couplings are formed between the debosses 34 and the embosses 40 and between the perimeter portions 32, 38 of the top and bottom pieces 24, 26 at a common plane 56 passing through the base assembly 14. In the depicted embodiment, the common plane 56 corresponds to a horizontal midplane generally dividing the top and bottom pieces 24, 26. As depicted, the embosses 40 are secured to the debosses 34 using a plurality of mechanical fasteners 58 including, but not limited to, screws, rivet studs, TOX joints, and/or the like. In assembly, each mechanical fastener 58 is received through a clearance 60 or a threaded aperture formed through abutting end portions 52, 46 of a corresponding emboss 40 and deboss 34. The mechanical fasteners 58 may each include a shank 61 that is exposed and extends upwardly past the top piece 24 and a head 62 that is nestled inside the corresponding emboss 40. In this manner, the head 62 of each mechanical fastener 58 is less exposed to handling. In some embodiments, one or more of the exposed shanks 61 may be secured to dryer components positioned in the dryer cavity 23. In alternative embodiments, one or more of the clearances 60 or threaded apertures may be configured to receive other structures therethrough or left unoccupied if desired.

Figure 5:
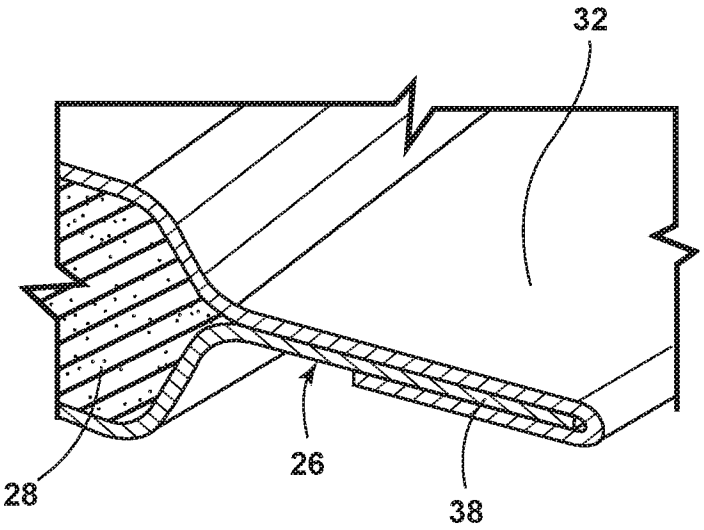
FIG. 5 is an enlarged view of area V in FIG. 2.

Referring to FIG. 5, one or more lengths of the perimeter portions 32, 38 of the top and bottom pieces 24, 26 are crimped together to further secure the top piece 24 to the bottom piece 26. In the depicted embodiment, a length of the perimeter portion 32 of the top piece 24 is crimped to a corresponding length of the perimeter portion 38 of the bottom piece 26. Alternatively, the perimeter portion 38 of the bottom piece 26 may be crimped to the perimeter portion 32 of the top piece 24. Alternatively still, the perimeter portions 32, 38 of the top and bottom pieces 24, 26 may be engaged to one another via mechanical fasteners, welds, or other compatible means.

Referring back to FIGS. 2 and 3, the intermediate member 28 is confined in the cavity 27 defined by the top and bottom pieces 24, 26 and surrounds at least a portion of the debosses 34 and the embosses 40 once the top and bottom pieces 24, 26 are secured to one another. In the depicted embodiment, the intermediate member 28 is dimensioned to fill a substantial entirety of the cavity 27 of the base assembly 14. With respect to the embodiments described herein, there are generally no entry points to the cavity 27 from the bottom piece 26, that is, the bottom piece 26 is completely sealed. Likewise, the top piece 24 may also be completely sealed so as to bar entry to the cavity 27. Optionally, the top piece 24 may include one or more attachment holes 64 formed in the upper platform 42 for securing dryer components to the base assembly 14.

To facilitate installation of the base assembly 14, the perimeter portion 32 of the top piece 24 may include one or more upward extending tabs 66 for securing the base assembly 14 to the side panels 20 of the dryer 10 or other household appliance. Additionally, the perimeter portions 32, 38 of the top and bottom pieces 24, 26 may each include one or more upward extending flanges 68, 70 for securing the base assembly 14 to the front and rear panels 16, 18 of the dryer 10 or other household appliance. In embodiments where the base assembly 14 is raised off the ground, complimentary flanged through holes 72 may be formed through corner portions of the top and bottom pieces 24, 26 to enable dryer legs to be received therethrough.

Accordingly, a base assembly of a dryer has been advantageously provided herein. The base assembly benefits from a modular two-piece design and is compatible with a variety of household appliances. Additionally, the base assembly provides means for reducing noise levels produced by the dryer and is easily installed thereto.

Modifications of the disclosure will occur to those skilled in the art and to those who make or use the disclosure. Therefore, it is understood that the embodiments shown in the drawings and described above are merely for illustrative purposes and not intended to limit the scope of the disclosure, which is defined by the following claims as interpreted according to the principles of patent law, including the doctrine of equivalents.

It will be understood by one having ordinary skill in the art that construction of the described disclosure, and other components, is not limited to any specific material. Other exemplary embodiments of the disclosure disclosed herein may be formed from a wide variety of materials, unless described otherwise herein.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature, or may be removable or releasable in nature, unless otherwise stated.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connector or other elements of the base assembly may be varied, and the nature or numeral of adjustment positions provided between the elements may be varied. It should be noted that the elements and/or assemblies of the base assembly may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes, or steps within described processes, may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further, it is to be understood that such concepts are intended to be covered by the following claims, unless these claims, by their language, expressly state otherwise. Further, the claims, as set forth below, are incorporated into and constitute part of this Detailed Description.

What is claimed is:

1. A dryer comprising:

a cabinet;

a dryer drum disposed in a cavity of the cabinet; and a base assembly comprising:

a top piece having a central portion, a perimeter portion enclosing the central portion, and a plurality of debosses formed from the central portion; and a bottom piece having a central portion, a perimeter portion enclosing the central portion, and a plurality of embosses formed from the central portion;

wherein the perimeter portion of the top piece is coupled to the perimeter portion of the bottom piece and the plurality of debosses are coupled to the plurality of embosses at a common plane passing through the base assembly, wherein the plurality of embosses are formed from a lower platform of the central portion of the bottom piece, the lower platform being dropped in relation to the perimeter portion of the bottom piece.

2. The dryer of claim 1, wherein the plurality of debosses are formed from an upper platform of the central portion of the top piece, the upper platform being elevated in relation to the perimeter portion of the top piece.

3. The dryer of claim 1, wherein the plurality of debosses each correspond to an indent having a frustoconical shape.

4. The dryer of claim 1, wherein the plurality of embosses each correspond to a raised relief having a frustoconical shape.

5. The dryer of claim 1, further comprising an intermediate member confined within a cavity defined by the top and bottom pieces, the intermediate member configured to reduce noise levels produced by the dryer.

6. The dryer of claim 1, wherein the common plane corresponds to a horizontal midplane dividing the top and bottom pieces.

7. A dryer comprising:

a cabinet;

a dryer drum disposed in a cavity of the cabinet; and a base assembly comprising:

a top piece having a plurality of debosses formed therefrom and each deboss having an end portion;

a bottom piece coupled to the top piece to define a cavity and having a plurality of embosses formed therefrom, each emboss vertically aligned with a corresponding deboss and each emboss having an end portion in abutting contact with the end portion of the corresponding deboss; and a plurality of mechanical fasteners configured to engage the end portions of the plurality of embosses to the end portions of the plurality of debosses.

8. The dryer of claim 7, wherein the plurality of mechanical fasteners are received in a clearance or threaded aperture formed through the end portions of the plurality of embosses and the plurality of debosses.

9. The dryer of claim 7, wherein the plurality of mechanical fasteners each include a shank that is exposed and extends upwardly past the top piece and a head that is nestled inside a corresponding emboss.

10. The dryer of claim 7, wherein the top piece and bottom pieces have perimeter portions that are crimped together.

11. The dryer of claim 7, further comprising an intermediate member confined within a cavity defined by the top and bottom pieces, the intermediate member configured to reduce noise levels produced by the dryer.

12. The dryer of claim 7, wherein couplings between the plurality of embosses and the plurality of debosses occur at a common plane passing through the base assembly and separating the top and bottom pieces.

13. A dryer comprising:

a cabinet;

a dryer drum disposed in a cavity of the cabinet; and a base assembly comprising:

a top piece having a plurality of debosses;

a bottom piece coupled to the top piece to define a cavity and having a plurality of embosses coupled to the plurality of debosses; and an intermediate member confined in the cavity and configured to surround couplings between the plurality of debosses and the plurality of embosses.

14. The dryer of claim 13, wherein the intermediate member is configured to align the top piece with the bottom piece.

15. The dryer of claim 13, wherein the intermediate member includes a plurality of through holes, each configured to accommodate a corresponding deboss and a corresponding emboss.

16. The dryer of claim 13, wherein the intermediate member is dimensioned to fill a substantial entirety of the cavity.

17. The dryer of claim 13, wherein the plurality of embosses are coupled to the plurality of debosses by a plurality of mechanical fasteners having shanks that are exposed and extend upwardly past the top piece and heads that are nestled inside corresponding embosses.

18. The dryer of claim 13, wherein the top piece and bottom pieces have perimeter portions that are crimped together.

19. The dryer of claim 13, wherein couplings between the plurality of embosses and the plurality of debosses occur at a common plane passing through the base assembly and separating the top and bottom pieces.

* * * * *